US005150780A

United States Patent [19]

Fischer

[11] Patent Number: 5,150,780

[45] Date of Patent: Sep. 29, 1992

[54] TREAD ELEMENT FOR MOVING PAVEMENT OR ESCALATOR

[75] Inventor: Moritz Fischer, Hergiswil, Switzerland

[73] Assignee: Fischer Moritz AG, Hergiswill, Switzerland

[21] Appl. No.: 676,203

[22] Filed: Mar. 27, 1991

[30] Foreign Application Priority Data

Mar. 28, 1990 [CH] Switzerland ..... 1007/90
Jan. 7, 1991 [CH] Switzerland ..... 0026/91

[51] Int. Cl.[5] ..... B66B 23/12
[52] U.S. Cl. ..... 198/333
[58] Field of Search ..... 198/333

[56] References Cited

U.S. PATENT DOCUMENTS 4,570,781 2/1986 Kappenhagen ..... 198/333
4,638,901 1/1987 Lunardi ..... 198/333 X
4,858,745 8/1989 Haas et al. ..... 198/333
4,984,672 1/1991 Saito et al. ..... 198/333

FOREIGN PATENT DOCUMENTS 0386512 9/1990 European Pat. Off. ..... 198/333
2161442 7/1972 Fed. Rep. of Germany ..... 198/333
0041377 3/1977 Japan ..... 198/333
0124885 10/1978 Japan ..... 198/333
2137580 10/1984 United Kingdom ..... 198/333

*Primary Examiner*—Robert P. Olszewski
*Assistant Examiner*—Cheryl L. Gastineau
*Attorney, Agent, or Firm*—Spensley Horn Jubas & Lubitz

[57] ABSTRACT

In order to provide a secure connection which can be produced in a simple manner by the pressure die casting method between edge strips (3) inserted in the step plate (2) of a step element and the step plate (2), the edge strips (3) have on their underside at least along their two longitudinal edges a respective tongue (6, 7). The cross sections of the latter two have the shape of a parallelogram with mutual identical angles or of a trapezoid and engage in corresponding grooves (8, 9) in the step plate (2) in the manner of a tongue-and-groove connection. Furthermore, these edge strips (3) are provided on their underside moreover with at least two cast-on locking pins (10) which extend downwards and through the adjacent step plate (2), and on whose free ends projecting downwards out of the step plate (2) a respective clamping ring (11) is clamped resiliently supported on the underside of the step plate 2.

18 Claims, 9 Drawing Sheets

TREAD ELEMENT FOR MOVING PAVEMENT OR ESCALATOR

The invention relates to a step element for moving walkway or staircase, having a step plate for receiving the persons to be transported, this step plate being provided in the region of at least one of its longitudinal edges with an edge strip secured thereto.

The provision of step elements with edge strips is already known, where it is either inadequate for the sometimes extremely harsh conditions of use to secure them by means of a few screws in the step element, when viewed over a relatively long period of use, and/or where relatively complicated machining of the step elements produced by the pressure die casting method are required.

It is the object of the present invention to provide a step element which does not have the above-mentioned disadvantages and which makes possible extremely simple assembly and, in a simple manner, good fixing of the edge strip over the entire length thereof.

This object is achieved with a step element of the type mentioned at the outset, in accordance with the invention as will be described below.

To achieve a die-casting die which is as simple as possible, it is advantageous if the step element, including the grooves intended for receiving the edge strip tongues and provided in the step plate, is produced by the pressure die casting method, and if the direction of insertion of these grooves and preferably the longitudinal axis of the locking pins as well as the associated through openings in the step plate run parallel to the direction of emergence of the step element out of the die-casting die during its production. Here, it is advantageous if the direction of insertion of the grooves and tongues runs at an angle of 25° to 50°, preferably 38°, with respect to a perpendicular to the plane of the step plate.

Advantageous further developments of the step element according to the invention will also be described.

The subject of the present invention is furthermore an edge strip for a strip element as claimed in one of claims 1 to 16.

The invention is explained below by way of example with reference to the drawing, in which.

Figure 2:
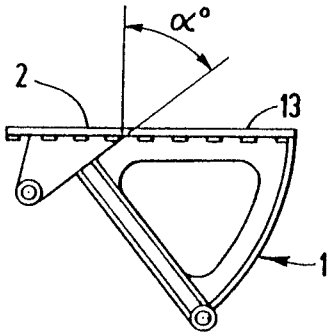
FIG. 2 shows a side view of the step element illustrated in FIG. 1.
Figure 1:
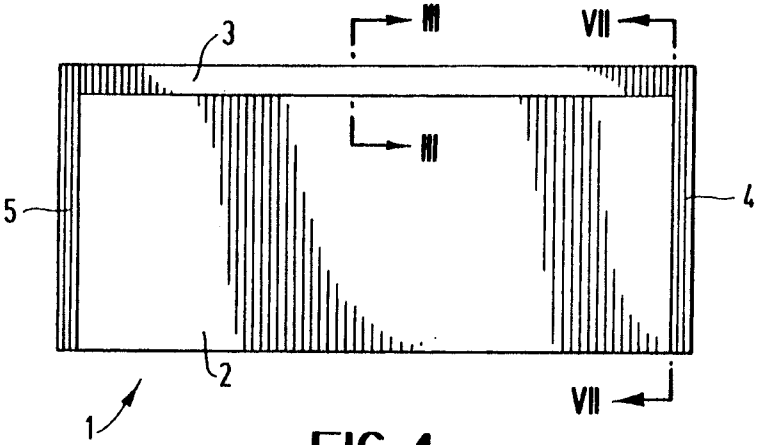
FIG. 1 shows an outline of an example embodiment of a step element according to the invention, intended for a moving staircase.

As can be seen from FIGS. 1 and 2, the step element 1 (called a moving staircase stair below) of a moving staircase is provided with a step plate 2 for receiving the person to be transported. The step plate 2 has, inserted in it and secured to it, edge strips 3, 4 and 5.

Figure 3:
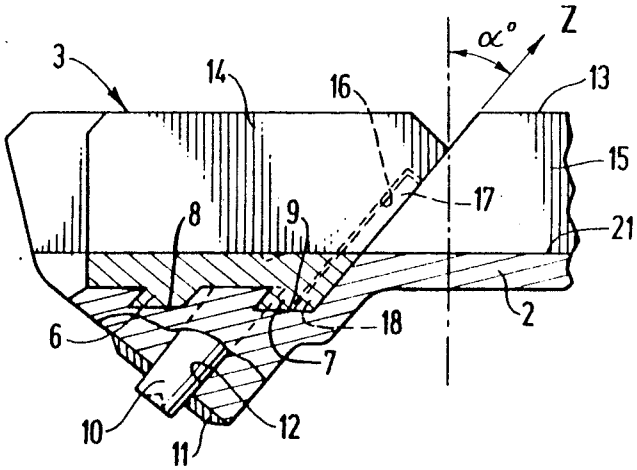
FIG. 3 shows a section along the line III—III in FIG. 1.
Figure 4:
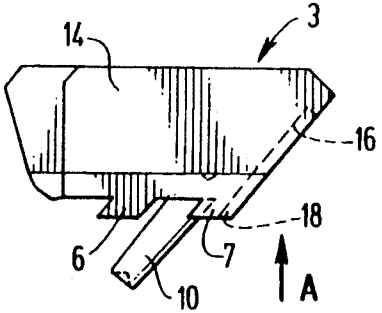
FIG. 4 shows a side view of the edge strip used in FIG. 3.
Figure 5:
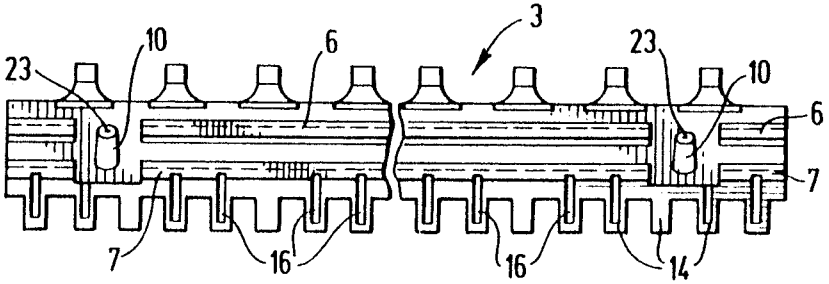
FIG. 5 shows a view in the direction of the arrow A in FIG. 4 of the underside of the edge strip.
Figure 6:
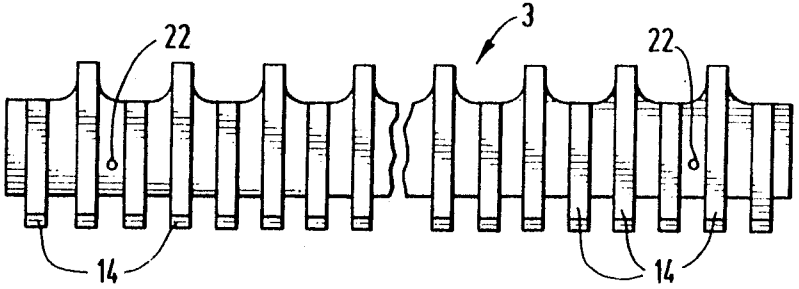
FIG. 6 shows a plan view of the edge strip illustrated in FIGS. 4 and 5.
Figure 7:
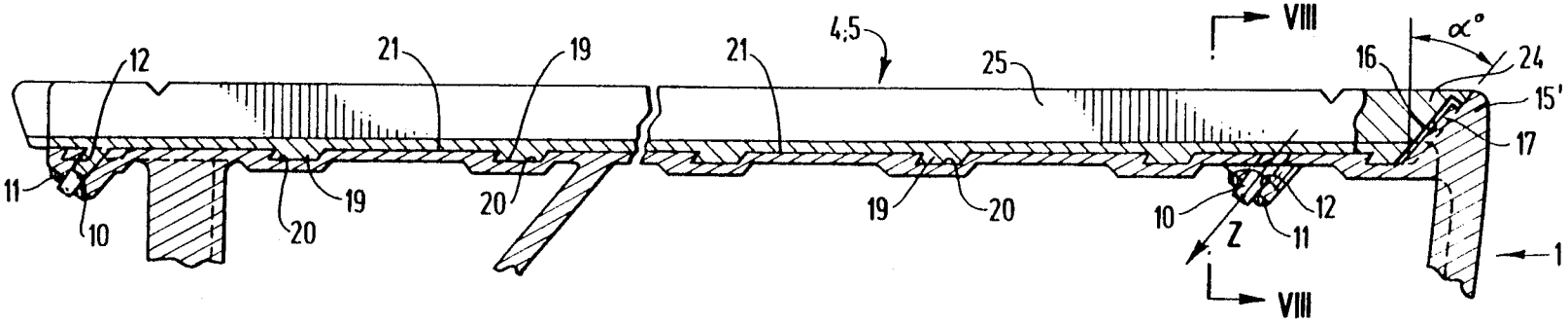
FIG. 7 shows a section along the line VII—VII in FIG. 1.

The rear edge strip 3 has, as can be seen from FIGS. 3, 4 and 5, on its underside along its two longitudinal edges a respective tongue 6 and 7, whose cross sections have the shape of a parallelogram with mutually identical angles, and engage in corresponding grooves, 8 and 9 respectively, in the step plate 2, in the manner of a tongue-and-groove connection.

This rear edge strip 3 furthermore has on its underside two guide and locking pins 10, which are arranged distributed over its length, which extend downwards and through the adjacent step plate 2 and which form one piece with the edge strip 3, and on whose free ends projecting downwards out of the step plate 2 there is firmly clamped a respective clamping ring 11 supported under spring-loaded pressure on the underside of the step plate 2.

The step element 1, including the grooves 8 and 9 intended for receiving the edge strip tongues 6 and 7 and provided in the step plate 2, is produced by the pressure die casting method, where the direction of insertion of these tongues 6, 7 and grooves 8, 9 and the longitudinal axis of the guide and locking pins 10 and the associated guide and through openings 12 in the step plate 2 runs parallel to the direction Z of emergence of the step element 1 out of the die-casting die during its production, so that a die-casting die which is as simple as possible may be produced. This direction Z of emergence runs at an angle $\alpha$ of 38° with respect to a perpendicular to the plane 13 off the step plate, in the example embodiment illustrated.

The edge strip 3 is provided with the same rib division as the step plate 2, where, for the purpose of reciprocal locking of the ribs 14 of the edge strip 3 with the ribs 15 of the step plate 2, some of the ribs 14 of the edge strip 3 are provided on their sides adjacent to the ribs 15 of the step plate 2 with guide grooves 16, in which there engages a respective guide comb 17, arranged on the end side, of the adjacent ribs of the step plate 2. For inserting the guide comb 17 into the associated guide grooves 16, the latter are open on their lower end side 18.

The two lateral edge strips 4 and 5 are, as can be seen from FIGS. 7 to 11, provided on their underside with a plurality of tongues 19, arranged distributed over their length and running in their transverse direction, the cross sections of these tongues 19, similarly to the tongues 6 and 7 of the rear edge strip 3, having the shape of a parallelogram with mutually identical angles and engaging in corresponding grooves 20 in the step plate 2 in the manner of a tongue-and-groove connection. These two lateral edge strips 4 and 5 are, similarly to the rear edge strip 3, also provided on their underside with two guide and locking pins 10, which are arranged distributed over their length, which extend downwards and through the adjacent step plate 2 and on whose free ends projecting downwards out of the step plate 2, similarly to the rear edge strip 3, a respective clamping ring 11 is clamped, supported under spring-loaded pressure on the underside of the step plate 2.

The guide and locking pins 10, the guide and through openings 12 associated therewith and the tongue-and-groove connections 19, 20 are, similarly to the rear edge strip 3, matched to one another such that they permit unimpeded insertion of the tongues 19 of the two edge strips 4 and 5 into the grooves 20, which are associated with these tongues 19 and are in the step plate 2.

The direction Z of insertion of the tongue-and-groove connection 19, 20 and of the guide and locking pins 10 is, for the purpose of a production which is as simple as possible from a production technology point of view, identical to that of the rear edge strip 3 already described previously.

Since the bearing surfaces 21, intended for the edge strips 3, 4 and 5 and offset from the plane of the step plate, and the grooves, 8 and 9 and 20 respectively, and the guide and through openings 12 may all be produced from above in producing the step element 1 in the die-casting die, that is to say from a single side of the die-casting die, then these edge strip anchoring grooves 8, 9 and 20 may be produced opposite the edge strip bearing surfaces 21 and the guide openings 12 so precisely in the pressure die casting method that any subsequent machining of the step elements 1 constructed in this manner, for a laterally virtually play-free mounting (without clamping rings 11, of the edge strips 3, 4 and 5 in the step plate 2, is superfluous, which represents a tremendous advantage from a production point of view.

Assembly of these edge strips 3, 4 and 5 is also extremely simple, since they may be simply inserted obliquely in the step plate 2 and then the clamping rings 11 may be pressed onto the free ends projecting on the underside of the step plate 2 of the guide and locking pins 10 inserted without play in the step plate 2.

The clamping rings 11 are of spring steel and are constructed to be convex so that they may be pressed in a simple way onto the locking pins 10 of slightly conical construction until they bear resiliently on the underside of the step plate 2, and they then automatically clamp there onto the locking pins. It is also possible to use as clamping rings 11 slightly convex tension plates or disk springs and so-called cord rib plates[1].

[1]Translator's Note: It has been assumed that "Schnorr" (=sponging or cadging) was an error for "Schnur" (=rope or cord).

Figure 11:
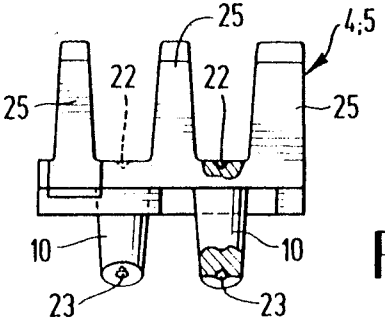
FIG. 11 shows an end view of the edge strip as seen in the direction of the arrow B in FIG. 9.
Figure 8:
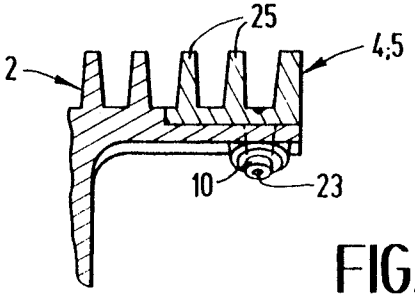
FIG. 8 shows a section along the line VIII—VIII in FIG. 7.
Figure 9:
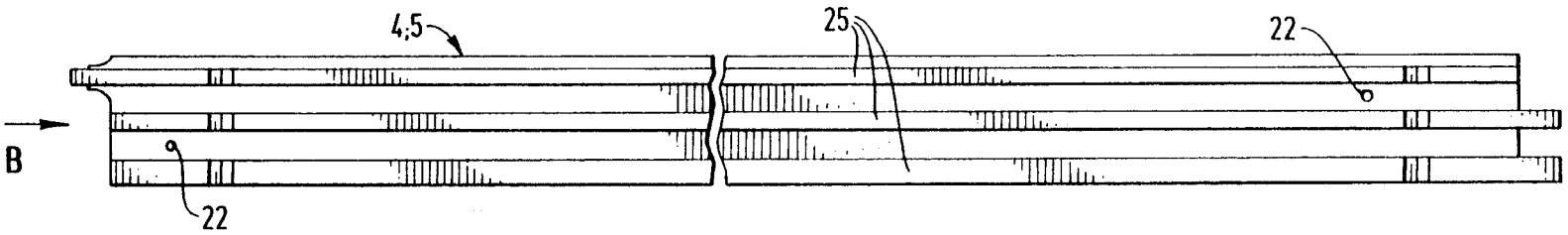
FIG. 9 shows a plan view of the edge strip used in FIG. 7.
Figure 10:
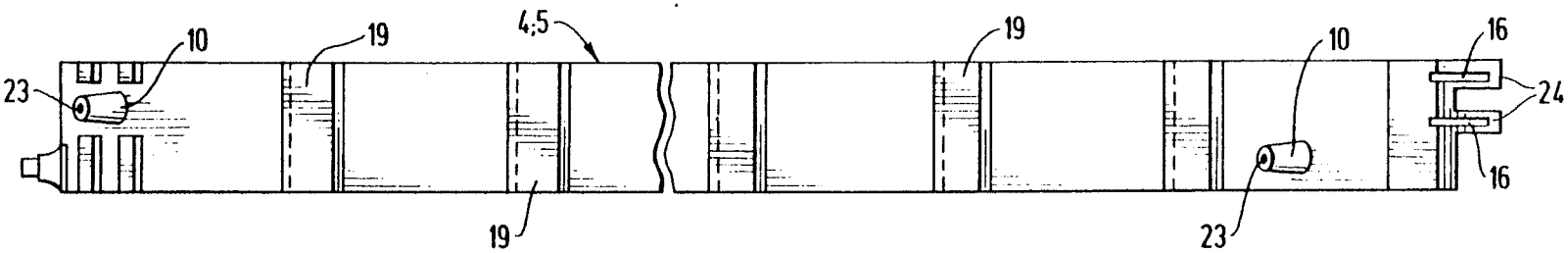
FIG. 10 shows a bottom view of the edge strip illustrated in FIG. 9.

In order that an edge strip 3, 4 or 5 secured in this manner can also be replaced in a simple manner in the event of damage in operation, they are provided, as can be seen for example from FIG. 11, in the longitudinal axis of the guide and locking pins 10 on the upper side of the edge strips 3, 4 and 5 and on the downwardly directed free end side of the guide and locking pins 10, centering spot facings 22 and 23 for centering a drill for the purpose of drilling out the guide and locking pin 10 concerned, so that the latter can be eliminated and the defective edge strips removed in a simple manner, without the subsequent fixing of a new edge strip resulting in any additional problems.

For the additional lateral anchoring of the front end sides 24 of the ribs 25 of the two lateral edge strips 4 and 5, these are also provided with guide grooves 16 in which a respective guide comb 17 of the moving staircase stair 1 engages (FIG. 7), similarly to the rear end strip 3.

Figure 12:
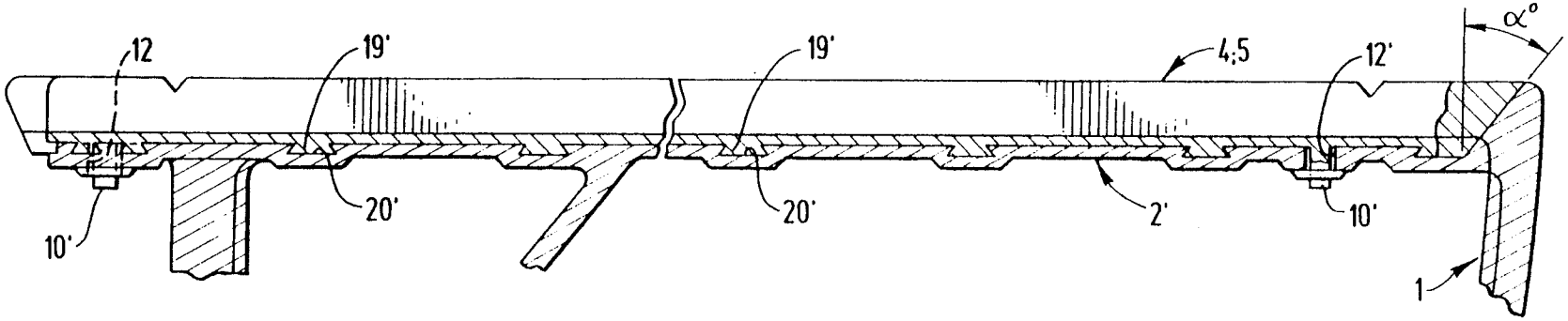
FIG. 12 shows a section similar to FIG. 8 through a further example embodiment of a lateral edge strip with dovetail-shaped tongues.
Figure 13:
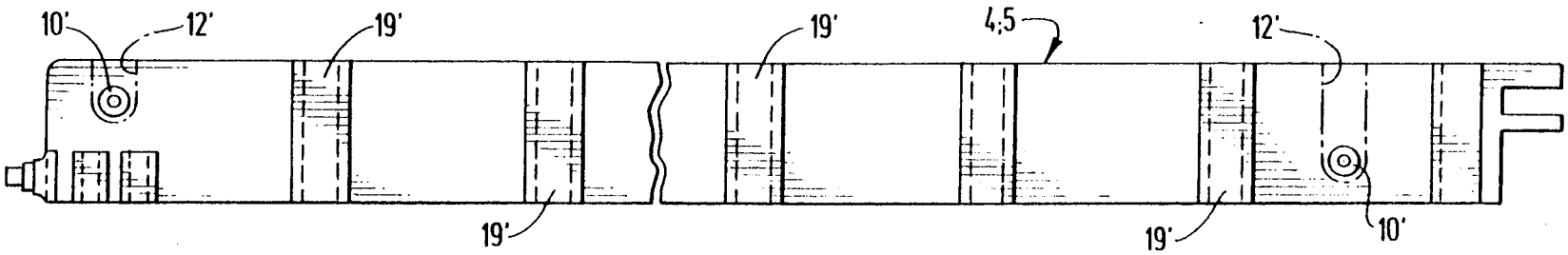
FIG. 13 shows a bottom view of the edge strip illustrated in FIG. 12.

In the embodiment illustrated by way of FIGS. 12 and 13, in contrast to the embodiment illustrated by way of FIGS. 7 to 11, the grooves 19' and the tongues 20' are provided with a dovetail-shaped cross section.

Such edge strips 4', 5' can be pushed into one another only in the lateral direction of these edge strips 4', 5', because of the shape of the grooves 19' and the tongues 20'. In order to make possible such a lateral pushing in, the through openings 12', provided in the step plate 2' for the locking pins 10', must be outwardly open at the side in the form of a slot.

Figure 15:
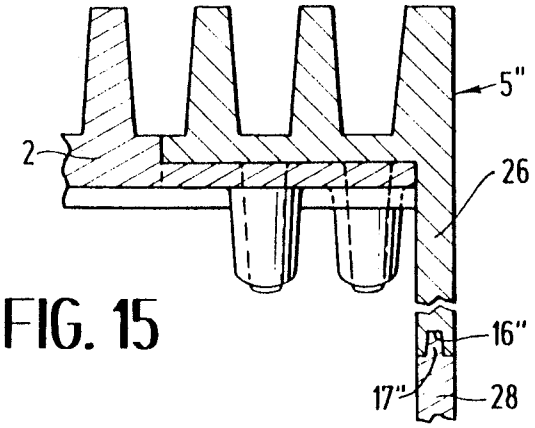
FIG. 15 shows a section along the line XV—XV in FIG. 14.
Figure 14:
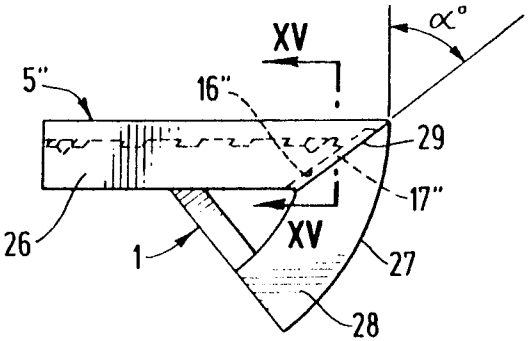
FIG. 14 shows a side view similar to FIG. 2 of a further example embodiment of a step element according to the invention.

As can be seen from FIGS. 14 and 15, it is also possible to construct the two lateral edge strips 4 and 5, at their longitudinal edge which is outwardly directed with respect to the step plate 2, with a downwardly extending first side apron 26 forming one piece with the edge strip 4 or 5 respectively, and the arcuate front wall 27 (see FIG. 14) of the step element 1 with two lateral second side aprons 28 extending downwards from the front wall 27. The common separation line 29 between the two respective side aprons 26, 28, partly abutting against one another, runs at an angle $\alpha$ which is equal to or greater than the direction Z of insertion of the tongue-and-groove connection 19, 20. Similarly to the ribs, 14 and 25 respectively, of the edge strips 3, 4 and 5, the side aprons 26 of the edge strips, 5" and 4" (not shown) respectively, are provided in their region adjacent to the associated side aprons 28 with a respective guide groove 16" in which there engages for reciprocal lateral fixing and centering a guide comb 17" of the associated side apron 28 of the step element 1.

Normally, the moving staircase stairs are of a magnesium alloy and the edge strips 3, 4 and 5, together with the locking pins 10 provided thereon, are of weather- and shock-resistant and ageing-resistant plastics.

Figure 17:
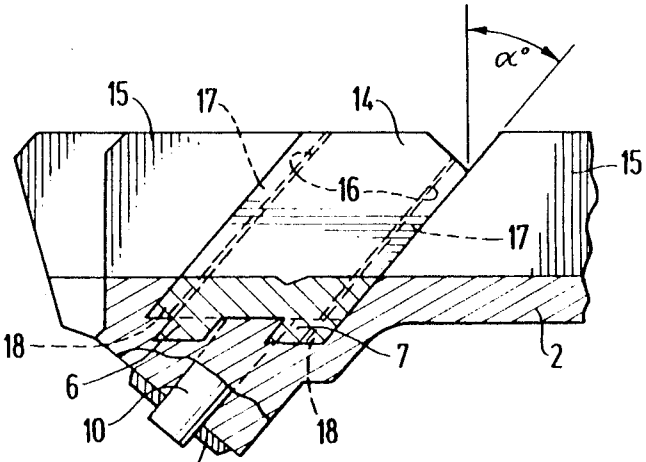
FIG. 17 shows a section along the line XVII—XVII in FIG. 16.
Figure 16:
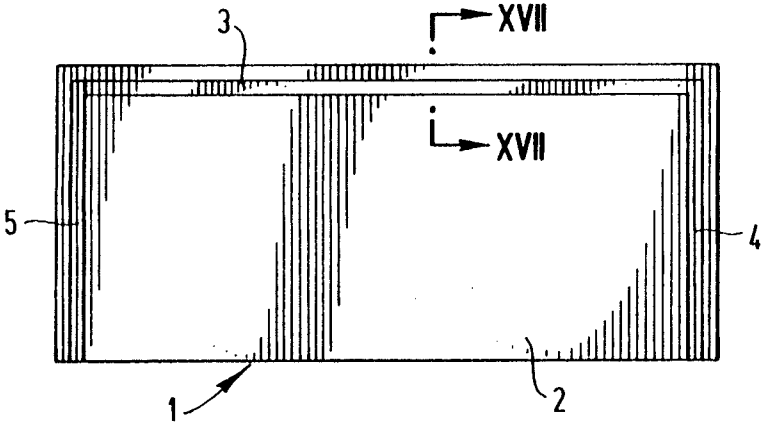
FIG. 16 shows an outline similar to FIG. 1 of a further example embodiment of the step element according to the invention.
Figure 19:
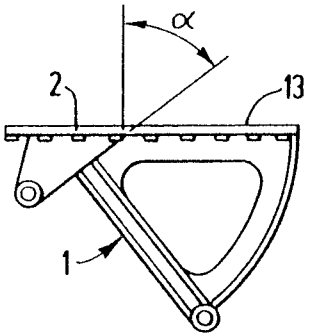
FIG. 19 shows a side view of the step element illustrated in FIG. 18.

In the embodiment illustrated in FIGS. 16 and 17, the edge strips 3, 4 and 5 are formed from signaling strips which are inserted in the step plate 2, are distanced from the outside of the latter, form part of the step surface of the step plate 2 and are of a different color, the plastics from which these edge strips are made being for example colored fluorescent yellow.

For lateral centering of its ribs 14 with respect to the ribs 15 of the step plate 2, the rear edge strip 3 has on both end sides of its ribs 14 guide grooves 16 in which there engage the guide combs 17 of the abutting end sides of the ribs 15 of the step plate 2. Here, too, the guide grooves 16 are open at their lower end 18 for pushing in the guide combs 17.

It goes without saying that it is also possible to provide the step plate 2 with edge strips on all four sides, in which case the front edge strip can be secured in the step plate 2 in a manner similar to the rear edge strip 3.

Parts in FIGS. 18 to 33 below which are similar to FIGS. 1 to 17 are provided with the same reference numerals, so that repeating a detailed description of the same parts becomes unnecessary, and only the differing features are described.

Figure 20:
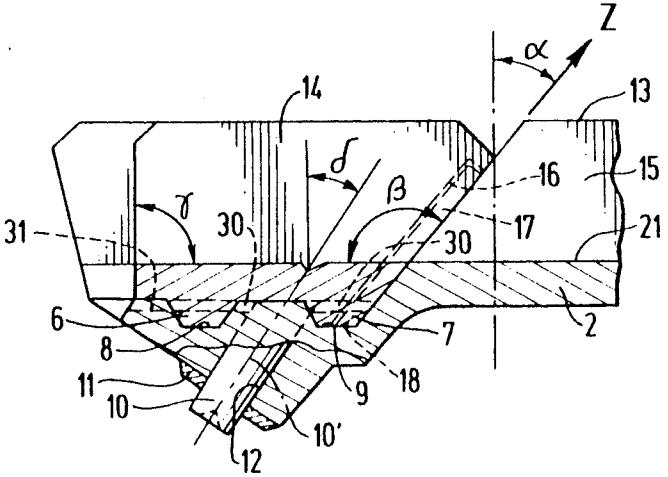
FIG. 20 shows a section along the line XX—XX in FIG. 18.
Figure 18:
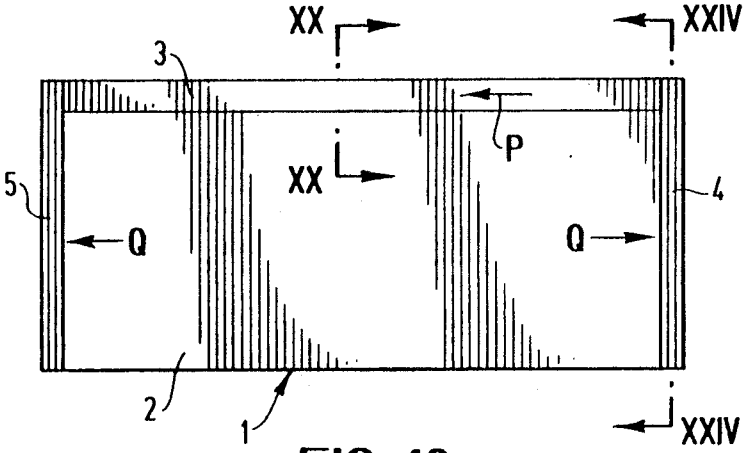
FIG. 18 shows an outline of a further example embodiment of a step element according to the invention, intended for a moving staircase.
Figure 21:
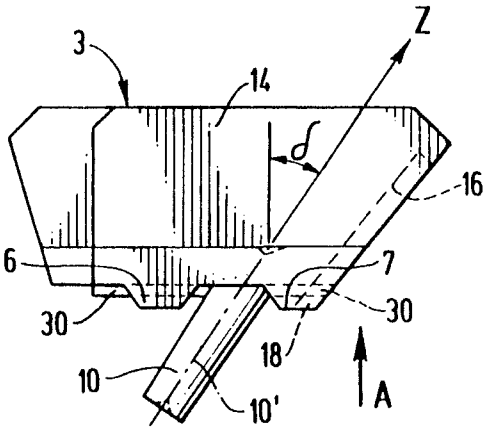
FIG. 21 shows a side view of the edge strip used in FIG. 20.
Figure 22:
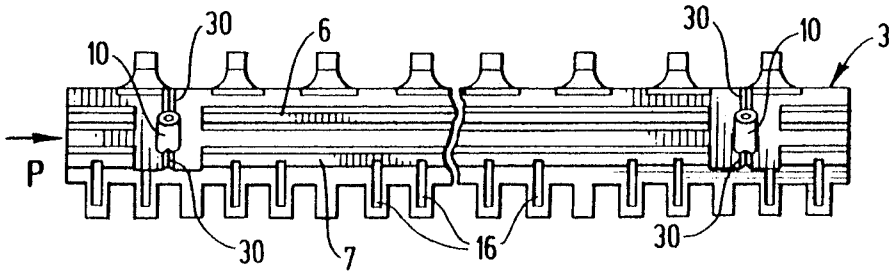
FIG. 22 shows a view of the underside of the edge strip in the direction of the arrow A in FIG. 21.
Figure 23:
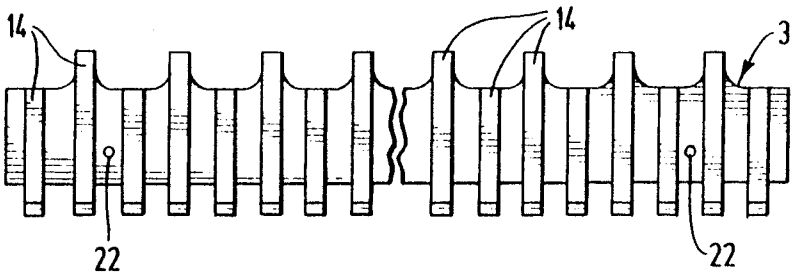
FIG. 23 shows a plan view of the edge strip illustrated in FIGS. 21 and 22.
Figure 24:
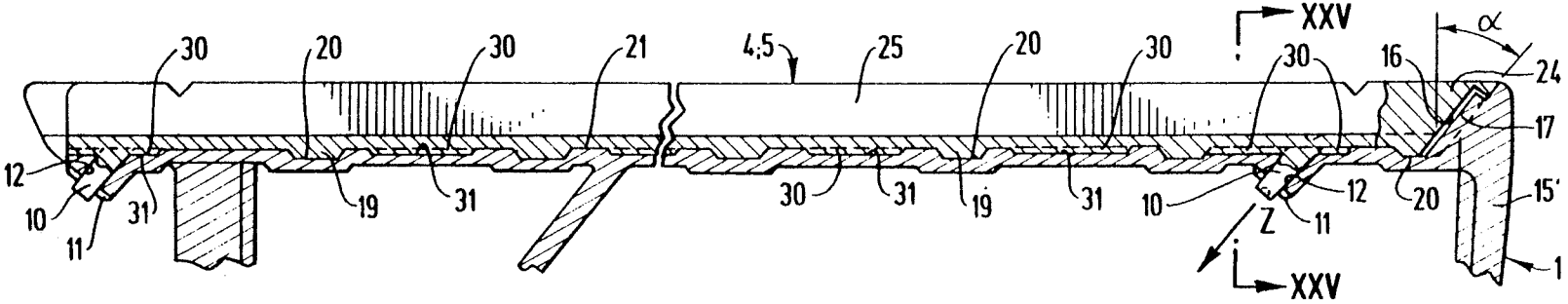
FIG. 24 shows a section along the line XXIV—XXIV in FIG. 18.
Figure 29:
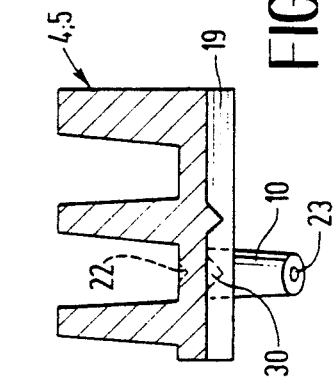
FIG. 29 shows a section along the line XXIX—XXIX in FIG. 27.
Figure 28:
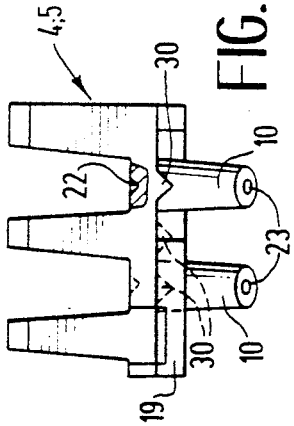
FIG. 28 shows an end view of the edge strip, as seen in the direction of the arrow B in FIG. 26.
Figure 25:
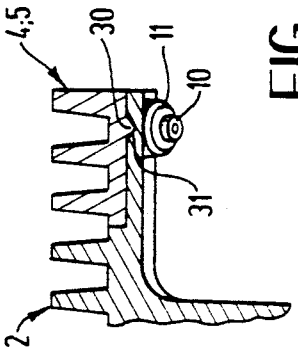
FIG. 25 shows a section along the line XXV—XXV in FIG. 24.
Figure 26:
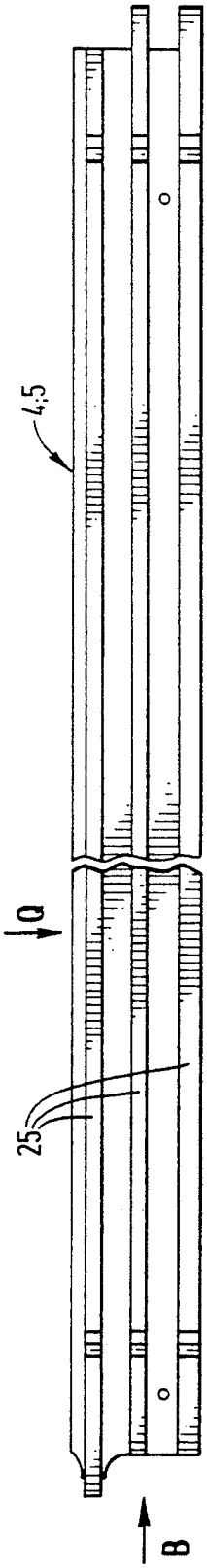
FIG. 26 shows a plan view of the edge strip used in FIG. 24.
Figure 27:
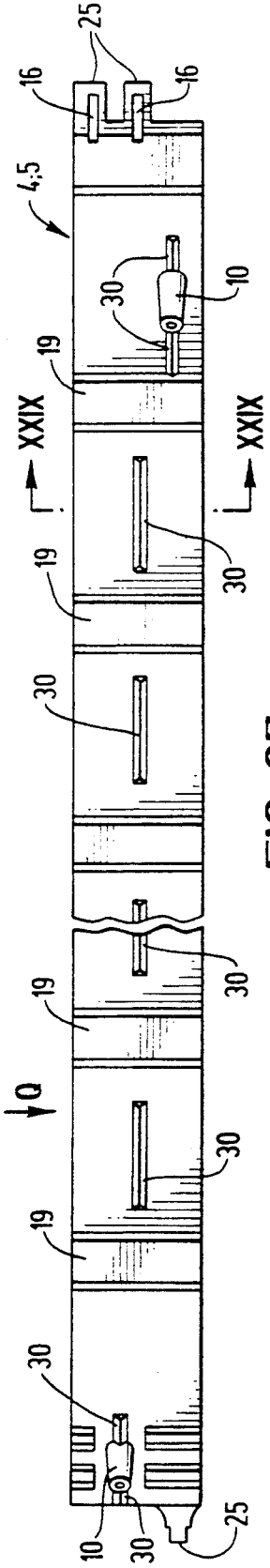
FIG. 27 shows a bottom view of the edge strip illustrated in FIG. 26.

In contrast to the previously described embodiments, the rear edge strip 3 has, as can be seen from FIGS. 20, 21 and 22, at its lower edge along its two longitudinal edges a respective tongue, 6 and 7 respectively, whose cross sections have the shape respectively of a trapezoid with mutually identical angles and engage in corresponding grooves, 8 and 9 respectively, in the step plate 2 in the manner of a tongue-and-groove connection.

In the embodiment of the mutually engaging tongues 6, 7 and grooves 8, 9 illustrated in FIGS. 18 to 30, the direction Z of emergence or the angle $\delta$ between the longitudinal axis 10' of the guide and locking pins 10 and a perpendicular to the plane 13 of the step plate may also be smaller than the angle $\alpha$.

In order to relieve tension in the guide and locking pins 10 from forces P acting on this edge strip 3 in the longitudinal direction of the front edge strip 3 or in the longitudinal direction of the tongue-and-groove connections 6, 7; 8, 9, there are provided on the underside of these edge strips 3, preferably in the region of the guide and locking pins 10, centering and tension-relieving projections or ribs 30 (see FIG. 22) which run transversely to the longitudinal direction of the tongues 6, 7 and have an approximately triangular cross section and engage locking with form fit in associated centering and tension-relieving grooves 31 provided in the step plate 2. The guide and locking pins 10 in turn also preferably engage locking with form fit and without play in the associated guide and through openings 12 provided in the step plate 2.

The two lateral edge strips 4 and 5 are, as can be seen from FIGS. 24 to 28, provided on their underside with a plurality of tongues 19 which are arranged distributed over their length, run in their transverse direction and whereof the cross sections, similarly to the tongues 6 and 7 of the rear edge strip 3, have the shape of a trapezoid with mutually identical angles and, as in the case of the example embodiments described by way of FIGS. 1 to 17, engage in corresponding grooves 20 in the step plate 2 in the manner of a tongue-and-groove connection.

In order to relieve tension in the guide and locking pins 10 and to remove laterally these lateral edge strips 4, 5 in their region between the guide and locking pins 10, in the case of forces Q acting on these edge strips 4, 5 transversely to the longitudinal direction of the lateral edge strips 4, 5 or in the longitudinal direction of the tongue-and-groove connections 19, 20 there are provided on the underside of these edge strips 4, 5 in the region of the guide and locking pins 10 and in the region between them, distributed over the entire length of these edge strips 4, 5, centering and tension-relief projections or ribs 30 (see FIGS. 25, 28 and 29) which run transversely to the longitudinal direction of the tongue-and-groove connections 19, 20 and transversely to the longitudinal direction of these edge strips 4, 5 and have an approximately triangular cross section, and which engage locking with form fit in associated centering and tension-relief grooves 31 provided in the step plate 2. In the case of these lateral edge strips 4, 5 too, the guide and locking pins 10 for their part engage, preferably also locking with form fit, without play in the associated guide and through openings 12 provided in the step plate 2.

Figure 31:
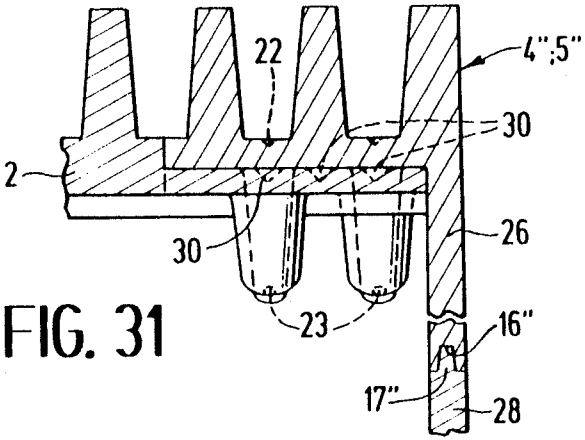
FIG. 31 shows a section along the line XXXI—XXXI in FIG. 30.
Figure 30:
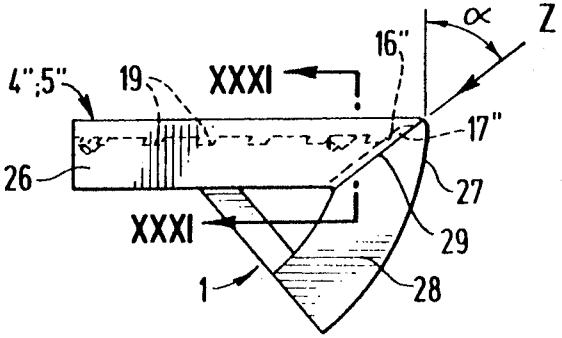
FIG. 30 shows a side view similar to FIG. 19 of a further example embodiment of a step element according to the invention.

As can be seen from FIGS. 30 and 31, it is also possible here to construct the two lateral edge strips 4 and 5, at their longitudinal edge directed outwards with respect to the step plate 2, with a downwardly extending first side apron 26 in one piece with the edge strip 4 or 5 respectively, and the arcuate front wall 27 (see FIG. 13) of the step element 1 with two lateral second side aprons 28 extending to the rear from the front wall 27.

Normally, the moving staircase stairs are of a magnesium alloy and the edge strips 3, 4 and 5, together with the locking pins 10 provided thereon, are of weather- and shock-resistant and ageing-resistant plastics.

Figure 33:
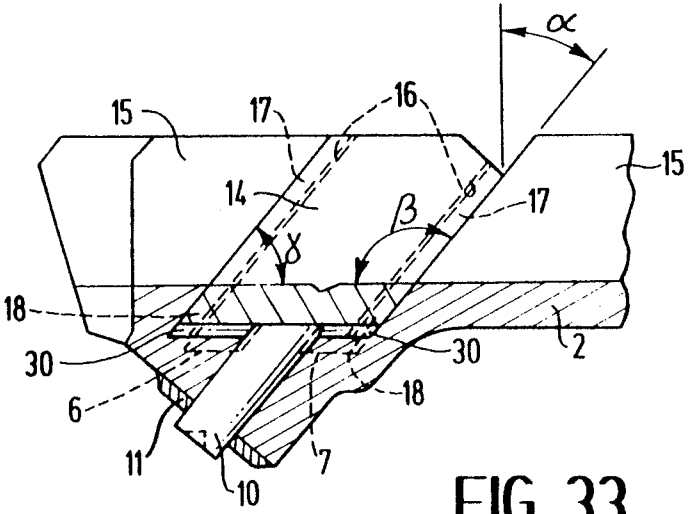
FIG. 33 shows a section along the line XXXIII—XXXIII in FIG. 32.
Figure 32:
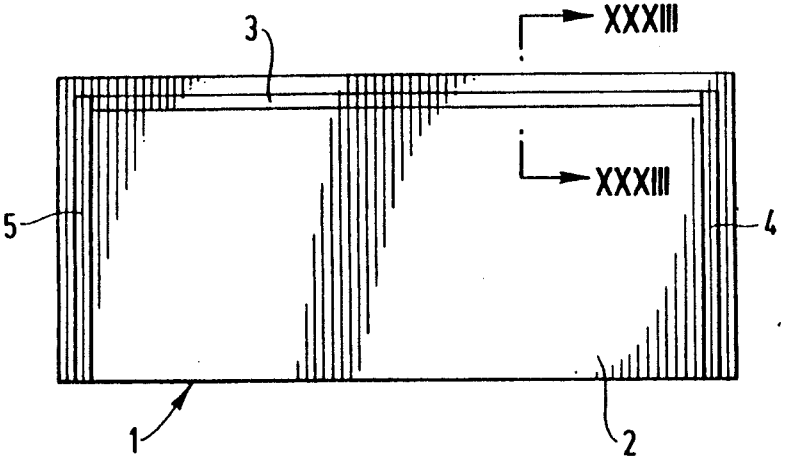
FIG. 32 shows an outline similar to FIG. 18 of a further example embodiment of a step element according to the invention.

In the embodiment illustrated in FIGS. 32 and 33, the edge strips 3, 4 and 5 are formed by signaling strips which are inserted in the step plate 2, are distanced from the outside of the latter, form part of the step surface of the step plate 2 and are of a different color, the plastics from which these edge strips are made being for example colored fluorescent yellow.

The rear edge strip 3 has, in addition to the centering and tension-relief projections 30, for lateral centering of their ribs 14 with respect to the ribs 15 of the step plate 2 on both end sides of their ribs 14, additional guide grooves 16 in which guide combs 17 of the abutting end sides of the ribs 15 of the step plate 2 engage. Here, too, the guide grooves 16 are open at their lower end 18 for pushing in the guide combs 17.

The tongues 6, 7 and associated grooves 8, 9 here have cross sections in the shape of a parallelogram for even better anchoring of the edge strips in the step plate 2.

What is claimed is:

1. Step element for moving walkway or staircase, having a step plate for receiving the persons to be transported, this step plate being provided in the region of at least one of its longitudinal edges with an edge strip secured thereto, wherein the edge strip, of which there is at least one, is provided on its underside, at least along its two longitudinal edges, with a respective tongue, each tongue having a cross section with a shape consisting of one of: a parallelogram with mutually identical angles; and at least approximately a trapezoid, and each tongue engages in a corresponding groove in the step plate in the manner of a tongue-and-groove connection, and wherein this edge strip moreover has on its underside at least two locking pins which are arranged distributed over its length, which extend downwards and through the adjacent step plate, and on whose free ends projecting downwards out of the step plate a respective clamping ring supported under spring-loaded pressure on the step plate are associated with these locking pins being matched to one another such that they permit unimpeded insertion of the tongues of the edge strip into the grooves which are associated with the tongues and are in the step plate.

2. Step element for moving walkway or staircase, having a step plate for receiving the persons to be transported, this step plate being provided, in the region of at least one of its longitudinal edges, with an edge strip secured thereto, wherein the edge strip, of which there is at least one, is provided on its underside with a plurality of tongues arranged distributed over its length which extend in its transverse direction, each tongue having a cross section with a shape consisting of one of: a parallelogram with mutually identical angles; and at least approximately the shape of a respective trapezoid, and each tongue engages in a corresponding groove in the step plate in the manner of a tongue-and-groove connection, and wherein this edge strip moreover has on its underside at least two locking pins which are arranged distributed over its length, and which extend downwards and through the adjacent step plate and on whose free ends projecting downwards out of the step plate a respective clamping ring is clamped supported under spring-loaded pressure on the step plate, these locking pins and the through openings which are associated therewith and are in the step plate being matched to one another such that they permit unimpeded insertion of the tongues of the edge strip into the grooves which are associated with them and are in the step plate.

3. Step element as claimed claim 1 or 2, wherein the base lines of the at least approximately trapezoidal cross sections of the tongues run at least approximately parallel to the plane of the step plate, in that, of the mutually analogous angles of the tongues, the one angle remote from the step plate is at least 110°, the other angle remote from the step plate is at most 90° and the sum of these two angles is at least 180°.

4. Step element as claimed in one of claims 1 or 2, wherein the edge strip, of which there is at least one, is provided on its underside with at least one centering projection which runs transversely to the tongues, and which has an at least approximately triangular cross section, and which engages with form fit in the longitudinal direction of the tongues, with a centering action in an associated centering cutout provided in the step plate.

5. Step element as claimed in claim 1 or 2, wherein the step element, including the grooves provided in the step plate and intended to receive the edge strip tongues, is produced by pressure die casting, and wherein the direction of insertion of these grooves and the associated through openings in the step plate runs parallel to the direction of emergence of the step element from the die-casting die during its production.

6. Step element as claimed in claim 5, wherein the direction of insertion of the grooves and tongues runs at an angle of 25° to 50° with respect to a perpendicular to the step plate plane.

7. Step element as claimed in one of claims 1 or 2, wherein the step plate is provided at least one of its outer edges with the edge strip.

8. Step element as claimed in one of claims 1 or 2, wherein the edge strip is formed by at least one signaling strip which is inserted in the step plate, is distanced from the outside of the latter, forms a part of the step surface of the step plate and is of a different color.

9. Step element as claimed in one of claims 1 or 2, wherein the edge strip is provided with the same rib division as the step plate, and wherein at least some of the ribs of the edge strip are provided on their sides adjacent to the ribs of the step plate with guide grooves in which there engages a respective guide comb, arranged on the end face, of the adjacent ribs of the step plate the guide grooves being open on their lower end sides for insertion of the associated guide combs.

10. Step element as claimed in one of claims 1 or 2, wherein in the longitudinal axis of the respective locking pins on at least one of the upper side of the edge strips and the downwardly directed end side of the individual locking pins there is provided a respective centering spot facing for centering a drill for drilling out and removing the locking pin concerned.

11. Step element as claimed in claim 1 or 2, wherein the locking pins run at least approximately perpendicular to the plane of the step plate, and wherein the through openings associated with these locking pins are constructed broadening, as seen in the direction of emergence.

12. Step element as claimed in one of claims 1 or 2, wherein the two lateral edge strips are provided at their longitudinal edge outwardly directed with respect to the step plate with a downwardly extending first side apron and the arcuate front wall of the step element is provided with two lateral second side aprons extending away backwards, wherein the common separation line between the two respective side aprons, partly abutting against one another, runs at an angle which is equal to or greater than the direction of insertion of the tongue-and-groove connection, and wherein the first side aprons are provided in their region adjacent to the associated second side apron with a respective guide groove in which there engages a guide comb of the associated second side apron.

13. Step element as claimed in claim 2, wherein the grooves and the tongues have a dovetail-shaped cross section.

14. Step element as claimed in claim 1 or 2, wherein the locking pins are constructed as guide pins and extend with the provision of a slide seating without play through the associated through openings in the step plate.

15. Step element as claimed in one of claims 1 or 2, wherein the locking pins are of slightly conical construction and the clamping rings, which are of spring steel and in the untensioned state are of slightly convex construction, are dimensioned in their internal diameter such that they are in clamping engagement with the associated locking pin, with resilient non-positive bearing against the underside of the step plate.

16. Step element as claimed in one of claims 1 or 2, wherein the locking pins are in one piece with the edge strip and these parts are produced from weather-and ageing-resistant and shock-resistant plastics.

17. An edge strip for a step element for a moving walkway or staircase, the step element having a step plate for receiving persons to be transported, the step plate having at least one longitudinal edge, said edge strip being arranged to be secured to the step plate in the region of the longitudinal edge of the step plate, said edge strip having two longitudinal edges and an underside and being provided, at the underside and along each of the longitudinal edges of said edge strip, with a respective tongue, each tongue having a cross section with a shape consisting of one of: a parallelogram with mutually identical angles; and at least approximately a trapezoid, and each tongue engages in a corresponding groove in the step plate in the manner of a tongue-and-groove connection, and wherein this edge strip moreover has on its underside at least two locking pins which are arranged distributed over its length, which extend downwards and through the adjacent step plate, and on whose free ends projecting downwards out of the step plate a respective clamping ring supported under spring-loaded pressure on the step plate is firmly clamped, these locking pins and the through openings which are in the step plate and are associated with these locking pins being matched to one another such that they permit unimpeded insertion of the tongues of the edge strip into the grooves which are associated with the tongues and are in the step plate.

18. An edge strip for a step element for a moving walkway of staircase, the step element having a step plate for receiving persons to be transported, the step plate having at least one longitudinal edge, said edge strip being arranged to be secured to the step plate in the region of the longitudinal edge of the step plate, said edge strip having two longitudinal edges and an underside and being provided, at the underside with a plurality of tongues arranged distributed over its length which extend in its transverse direction, each tongue having a cross section with a shape consisting of one of: a parallelogram with mutually identical angles; and at least approximately the shape of a respective trapezoid, and each tongue engages in a corresponding groove in the step plate in the manner of a tongue-and-groove connection, and wherein this edge strip moreover has on its underside at least two locking pins which are arranged distributed over its length, and which extend downwards and through the adjacent step plate and on whose free ends projecting downwards out of the step plate a respective clamping ring is clamped supported under spring-loaded pressure on the step plate, these locking pins and the through openings which are associated therewith and are in the step plate being matched to one another such that they permit unimpeded insertion of the tongues of the edge strip into the grooves which are associated with them and are in the step plate.

* * * * *